US006481489B1

(12) United States Patent
Jones

(10) Patent No.: US 6,481,489 B1
(45) Date of Patent: Nov. 19, 2002

(54) REINFORCED CASTING

(76) Inventor: Melvin A. Jones, 340 E. County Rd. 16, Tiffin, OH (US) 44883

( * ) Notice: Subject to any disclaimer, the term of this patent is extended or adjusted under 35 U.S.C. 154(b) by 133 days.

(21) Appl. No.: 09/631,336

(22) Filed: Aug. 3, 2000

Related U.S. Application Data

(63) Continuation-in-part of application No. 09/014,182, filed on Jan. 27, 1998, now abandoned.

(51) Int. Cl.[7] ..... B22D 17/02

(52) U.S. Cl. ..... 164/316; 164/312; 164/317; 164/318

(58) Field of Search ..... 164/316, 138, 164/312, 317, 318, 75

(56) References Cited

U.S. PATENT DOCUMENTS

| | | | | |
|---|---|---|---|---|
| 1,302,564 A | | 5/1919 | Klocke | |
| 2,243,273 A | | 5/1941 | Edwards | |
| 2,710,997 A | * | 6/1955 | Krepps | 164/98 |
| 3,284,860 A | | 11/1966 | Gurak | |
| 3,469,621 A | | 9/1969 | Fulgenzi | |
| 3,476,549 A | | 11/1969 | Glaesener | |
| 3,486,552 A | | 12/1969 | McCarroll | |
| 3,777,943 A | | 12/1973 | Spalding et al. | |
| 4,091,970 A | * | 5/1978 | Komiyama et al. | 222/596 |
| 4,231,416 A | | 11/1980 | Nikolov et al. | |
| 4,408,651 A | | 10/1983 | Smedley et al. | |
| 4,556,098 A | * | 12/1985 | Hintermann et al. | 164/316 |
| 4,635,851 A | * | 1/1987 | Zeeman | 239/133 |

FOREIGN PATENT DOCUMENTS

| | | | |
|---|---|---|---|
| JP | 5-285621 | * 11/1993 | 164/316 |

OTHER PUBLICATIONS

Republic "Endurs" Stainless Steels, Republic Steel Corp. Jul. 1952, pp. 6–9, 67–68, 79–86.*

Republic "Endurs" Stainless Steels, pp. 6–9, 67–68, 79–86 (no date available).

* cited by examiner

*Primary Examiner*—Tom Dunn
*Assistant Examiner*—I.-H. Lin
(74) *Attorney, Agent, or Firm*—Emch, Schaffer, Schaub & Porcello Co., L.P.A.

(57) ABSTRACT

A reinforced casting assembly formed of ferrous metal for use with hot chamber die casting including a gooseneck, nozzle seat and nozzle. Reinforcing members are used to reinforce the casting. The preferred embodiment is reinforcing the gooseneck as this is where most failures created by the high internal pressure of hot melt die casting occur. The reinforcing members generally are made of steel wire such as a solid or braided wire.

19 Claims, 4 Drawing Sheets

REINFORCED CASTING

RELATED APPLICATIONS

This patent application is a continuation-in-part of patent application Ser. No. 09/014,182 filed on Jan. 27, 1998, now abandoned.

TECHNICAL FIELD

This invention relates to a reinforced casting intended for use in hot chamber die casting processes.

BACKGROUND ART

Die casting machines generally utilize one of two classifications of casting material pumping systems, either a hot chamber system or a cold chamber system. Hot material chamber die casting machines include parts that are partially submerged in a vat containing the molten metal and thus operate at the temperature of the metal bath. Cold chamber die casting machines are unheated except for the die member which receives the molten metal during the casting process. Hot chamber systems are used primarily for the casting of metals having low melting points such as tin, zinc and lead alloys. Cold chamber machines can be used for die casting most metals, however, they are most commonly used for aluminum, magnesium and copper alloys.

The portions of the hot chamber die casting machine that come in contact with the molten metal must have good wear resistance, hardening resistance and softening resistance at the operating temperature of the machine. This is particularly true with the nozzle, nozzle seat and gooseneck sections of hot chamber machines. These components must be able to withstand the continuous washing action of the heated molten metal and maintain their dimensional and structural integrity in spite of the corrosive properties of the molten metal and the extreme temperature and pressure gradients to which they are exposed. The nozzle, nozzle seat and gooseneck of the machine are exposed to injection pressures commonly ranging from 2,000 to 6,000 psi, but can vary with injection pressures sometimes ranging as high as 30,000 psi. Hardening occurs from repeated crystallization and failure results from cracking.

The industry has lavished great care in choosing materials for the construction of hot chamber die casting machines. Improved materials for the various parts have led to enhanced resistance against wear, hardening and softening. The industry, however, has had little success in overcoming failure problems resulting from the high operating pressures present in the hot melt die casting process.

DISCLOSURE OF INVENTION

This invention is generally related to a reinforced casting and specifically related to a reinforced gooseneck and related components for use with a hot chamber die casting machine. The invention provides for the selected reinforcement of the gooseneck, nozzle, and nozzle seat. The preferred embodiment of the invention focuses on reinforcing the gooseneck as this is the location where most pressure-caused failures occur. The reinforcement structure is generally made of steel wire. The wire may be a solid or braided wire. The reinforcements generally have a shape or a combination of shapes. For example, the preferred embodiment is a combination of shapes, one of them being a U-shape with a tail and the other an inverted U-shape.

A gooseneck is commonly known to the casting industry as a unit designed to increase the pressure of a molten non-ferrous metal before it is forced or flowed into a die. Goosenecks are most commonly cast from molten grey iron such as cast iron, alloyed cast iron, and semi-steel. They may also be cast from molten steel or alloyed steel. In rare instances, Goosenecks are machined from a block of steel or alloyed steel.

Grey iron goosenecks have many advantages when compared to steel goosenecks. Grey iron is generally more stable when subjected to the heat levels found in hot melt die casting processes. The internal channel of the gooseneck cast from grey iron can also be cast, thereby allowing for the creation of a smooth path having gentle curves for the molten non-ferrous metal to flow through to the die. A smoothly flowing molten metal has less turbulence and therefore the final die cast product is denser and has less porosity. The preferred internal channel of a grey iron gooseneck is also preferably cast to have a gradually reducing diameter in the direction of fluid flow. However, a major disadvantage of grey iron goosenecks lies in the low tensile strength of grey iron as compared to steel and resultant failures when the goosenecks are subjected to regular and sustained high pressure levels.

Goosenecks cast or machined from steel, on the other hand, have greater strength than grey iron castings. Steel goosenecks, however, have several disadvantages. The internal channel must be machined or drilled, thereby creating sharp angular corners which tend to interfere with the smooth flow of molten metal creating considerable turbulence and frothing of the molten metal. Such turbulence and frothing lowers the pressure of the molten metal entering the die cavity and increases the porosity of the metal flowing into the die cavity. Further, plugs must be installed where the channels were machined or drilled and the plugs create an area of weakened structure in the gooseneck, thus creating an enhanced chance of failure of the gooseneck, as well as additional maintenance.

The present invention provides a cast grey iron gooseneck having steel reinforcements fused with the grey iron around the internal channel. The reinforced gooseneck of this invention offers the strength advantages of steel combined with the positive advantages of grey iron goosenecks. The invention provides a high strength gooseneck with a smooth internal channel, preferably having a gradually reduced diameter and having gentle curves, and a good stability when exposed to the extreme heat of the hot melt die casting process.

The same principals discussed above are applicable to the nozzle and nozzle seats. Other embodiments envision bimetallic components using an expensive or exotic metal, such as austenitic stainless steel as a core surrounding the internal channel of the gooseneck, nozzle and nozzle seat with the reinforced casting surrounding the exotic metal core. Finally, it is envisioned that other embodiments of the invention will provide reinforced cast steel goosenecks for certain desired applications.

DETAILED DESCRIPTION OF THE DRAWINGS

FIGS. 2A to 7A are cross-sections of a gooseneck, showing various embodiments of the invention taken along line A–A' of FIG. 1.

FIGS. 2B to 7B are core cross-sections of a gooseneck, showing the various embodiments of FIGS. 2A–7A, taken along line B–B' of FIG. 1.

DETAILED DESCRIPTION OF THE INVENTION

This assembly for use with hot chamber die casting comprises a gooseneck assembly having a channel extending therethrough, wherein the gooseneck assembly is made from a ferrous material having reinforcing members. The gooseneck assembly has an exterior surface, an interior surface and an interior located between the exterior and interior surfaces. The interior surface defines the channel extending therethrough, and the reinforcing members are located in the interior of the gooseneck assembly. Generally, the reinforcing members are centrally located in the interior between the exterior and interior surfaces. Preferably, the reinforcing members are located equidistant in the interior between the exterior and interior surfaces. In one embodiment, the casting includes a transition layer between the interior of the gooseneck assembly and the reinforcing members, wherein the transition layer is a mixture of the interior and the reinforcing members. This transition layer is a fused layer of the mixture. The reinforcing members are fused within the ferrous material provide radially oriented reinforcement within the interior of the gooseneck assembly.

Figure 1:
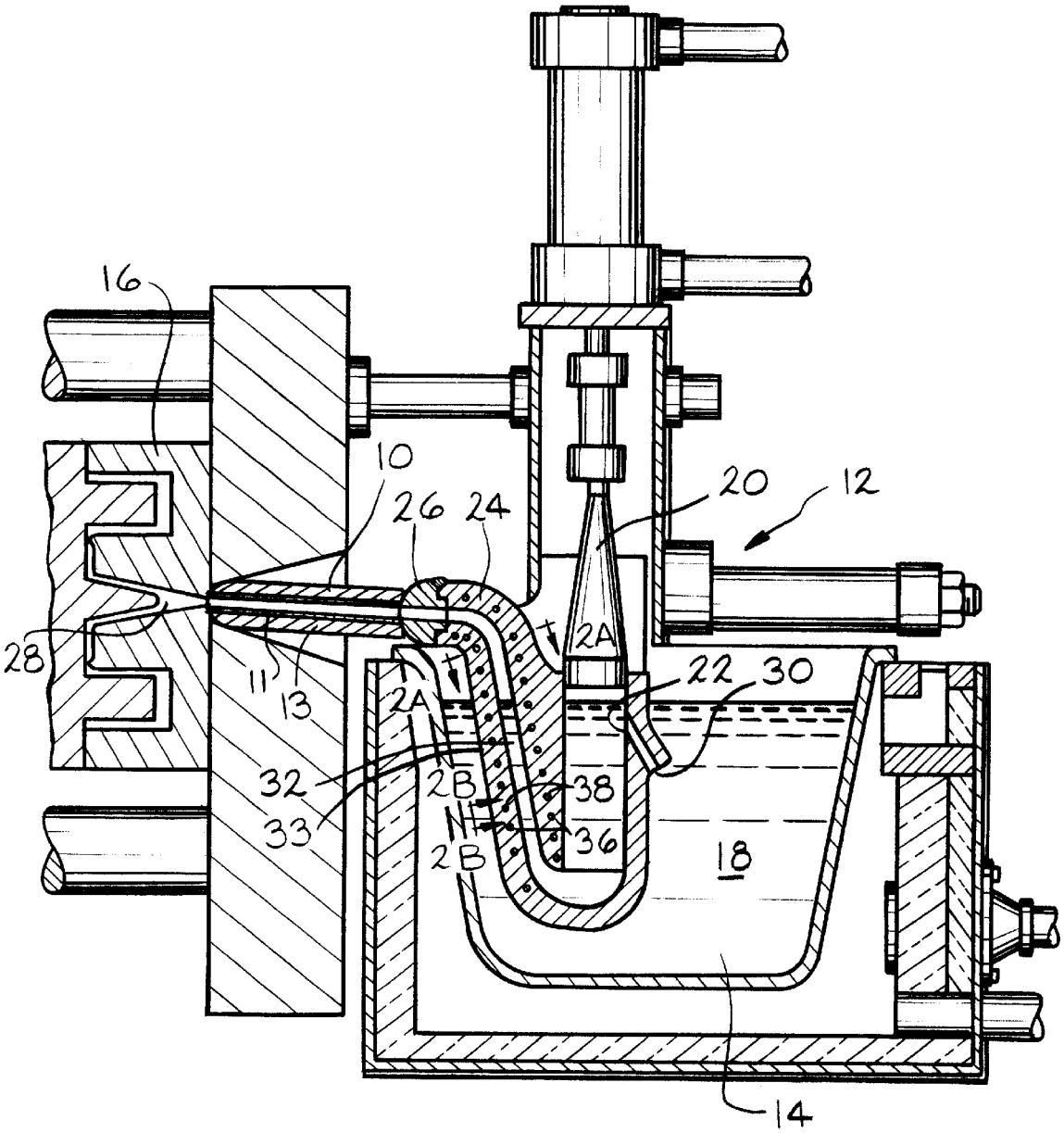
FIG. 1 is a cross-sectional side elevational view of a die casting machine and die according to the present invention.

FIG. 1 shows a hot chamber die casting machine having a submerged plunger mechanism, a gooseneck and a nozzle. The machine 12 consists of a molten metal reservoir 18, a plunger 20, pressure cylinder 22, gooseneck 24, nozzle seat 26 and nozzle 10. The nozzle 10 is designed to matingly engage with a die cavity 28 of a die 16 so that molten metal 14 is received into the die cavity 28 from the machine operation.

The gooseneck 24 and pressure cylinder 22 are partially submerged in the reservoir 18 of molten non-ferrous metal 14. An intake port 30 provides a passageway between the pressure cylinder 22 and the reservoir 18. With the plunger 20 in the up position (as shown in FIG. 1), molten metal 14 is free to flow from the reservoir 18 through the intake port 30 and into the pressure cylinder 22. When the plunger 20 is moved downward, it passes the intake port 30, thereby sealing off the pressure cylinder 22 from the reservoir 18. As the plunger 22 continues to travel downward, it pressurizes the molten metal 14 and forces the molten metal 14 contained in the cylinder 22 through the channel 32 in the gooseneck 24, through the nozzle seat 26 and the nozzle 10, into the die cavity 28 of the die 16, thereby filling the cavity and forming the cast part.

After the metal has solidified in the die cavity 28, the plunger 20 is retracted, thereby uncovering the intake port 30 and molten metal again flows from the reservoir 18 into the pressure cylinder 22, thus readying the machine 12 for the next cycle.

Figure 2A:
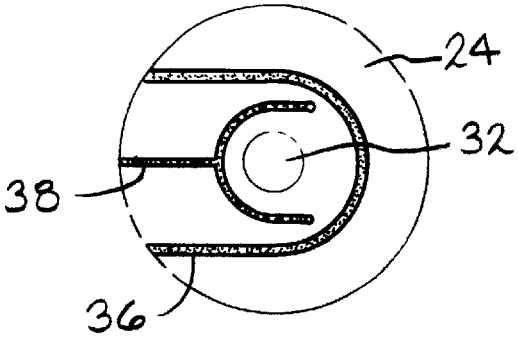
Figure 2B:
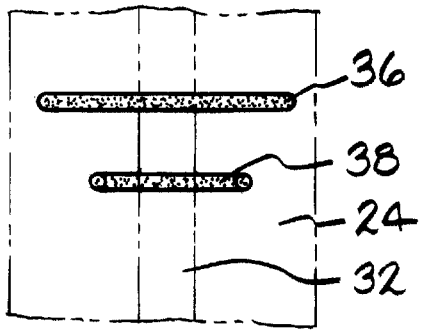

FIGS. 2A and 2B show a preferred embodiment of the reinforcing members 36, 38 positioned around the channel 22. The reinforcing members include a first "U"-shaped member with a tail 38 and an inverted "U"-shaped member 36 positioned in opposed relationship to the first "U"-shaped member. If the reinforcing members 36, 38 have differing shapes, they are alternatingly spaced along the length of the internal channel 32. The gooseneck 24 is most commonly cast in sand molds using a ferrous metal, preferably grey iron or cast iron, and the reinforcing members 36, 38 are formed of steel wire fused with the grey iron in the gooseneck during its manufacture by casting. The steel reinforcing members 36, 38 provide radially oriented reinforcement within the cast body of the gooseneck and assist the gooseneck casting in withstanding the pressures exerted within the channel 32 by the molten metal. The reinforcing members 36, 38 are alternatingly positioned in spaced relationship the full length of the channel 36 along the gooseneck 24. The preferred material for the reinforcing members 36, 38 is 41/40 steel or stainless steel because of the high strength characteristics and stability of 41/40 steel and stainless steel when exposed to the nonferrous molten metal used in the die casting process.

Preferably, the reinforcements 36, 38 are always positioned in the grey iron to be perpendicular to the longitudinal extension of the internal channel 32. The reinforcements 36, 38 are ideally spaced, in an alternating pattern, a distance of approximately two to three times the cross-sectional thickness of the reinforcement 36, 38 from each other. Each reinforcement is also ideally spaced a distance of two to three times it cross-sectional thickness from the internal channel 32, but no greater a distance than one-half the distance between the internal channel 32 and the exterior surface 33 of the gooseneck 24. In the preferred embodiment shown in FIGS. 2A and 2B, the surface of the reinforcements are roughened or notched to enhance the anchoring or fusing of the reinforcement in the cast grey iron.

Figure 3A:
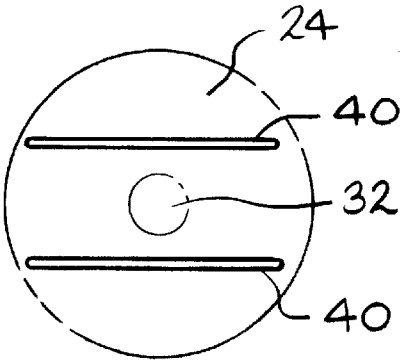
Figure 3B:
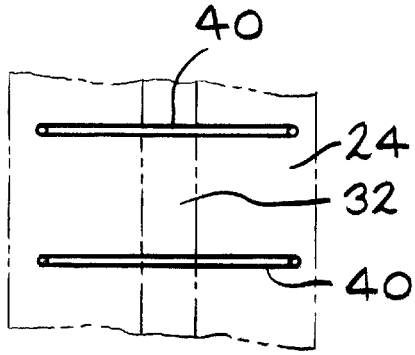

Other embodiments of reinforcing the gooseneck are envisioned. For instance:

FIGS. 3A and 3B show a pair of straight reinforcing members 40 extending through the gooseneck 24 in opposed and parallel relationship. Straight reinforcing members 40 also are preferred in the more curved portions of gooseneck 24. Curved and shaped reinforcements are more difficult to position in the curved portions of gooseneck 24 such as the neck area near nozzle seat 26.

Figure 4A:
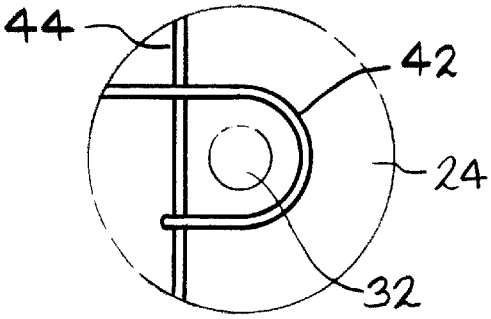
Figure 4B:
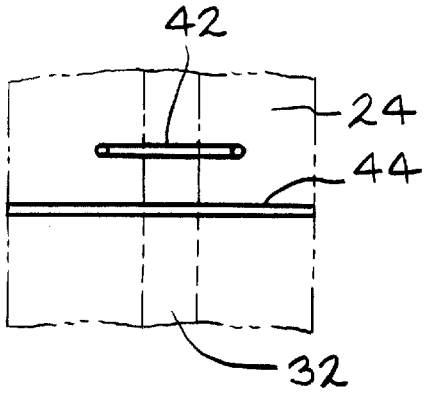

FIGS. 4A and 4B show a loop reinforcing member 42 and a straight reinforcing member 44 extending through the gooseneck 24 substantially to surrounding the channel 32.

Figure 5A:
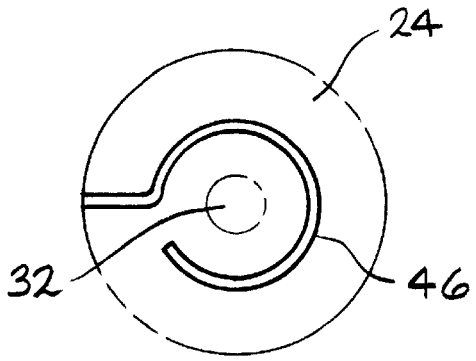
Figure 5B:
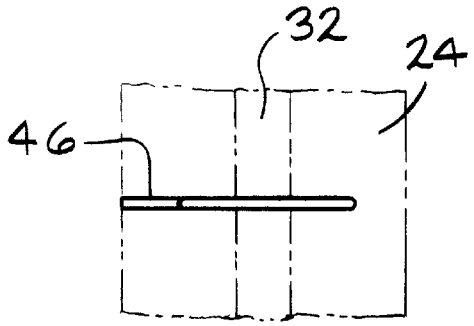

FIGS. 5A and 5B show an eye-shaped reinforcing member 46 extending into the gooseneck 24 and substantially surrounding the channel 32.

Figure 6A:
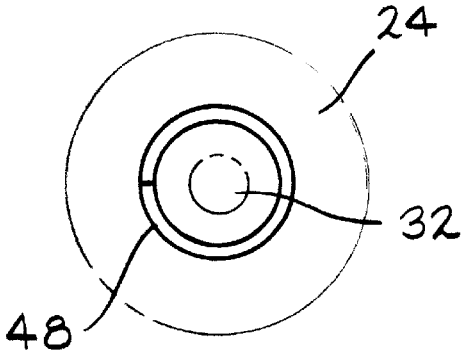
Figure 6B:
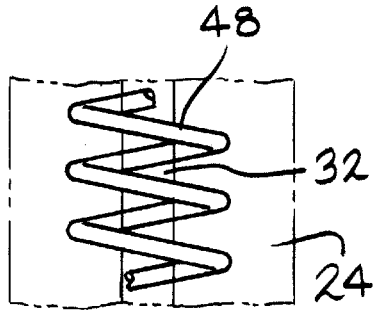

FIGS. 6A and 6B show a circular coil reinforcing member 48 through gooseneck 24 surrounding the channel 32.

Figure 7A:
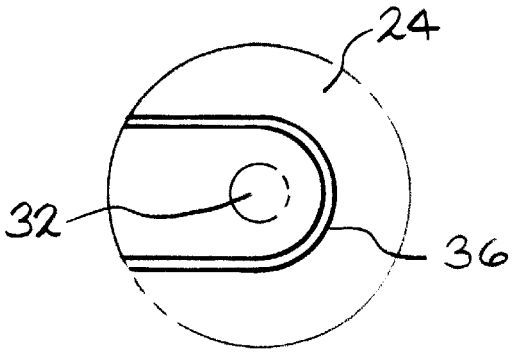
Figure 7B:
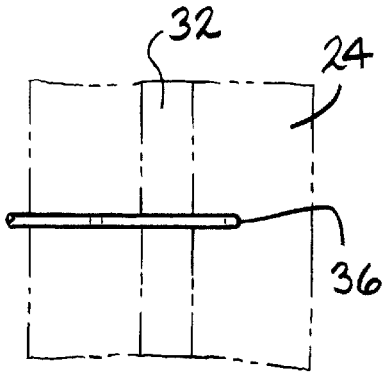

FIGS. 7A and 7B show a U-shaped reinforcement 36 through gooseneck 24.

The alternative embodiments of the reinforcing members shown in FIGS. 3A, 3B to 7A, 7B are intended to have the same physical and structural characteristic as those described above in reference to FIGS. 2A and 2B.

Figure 8:
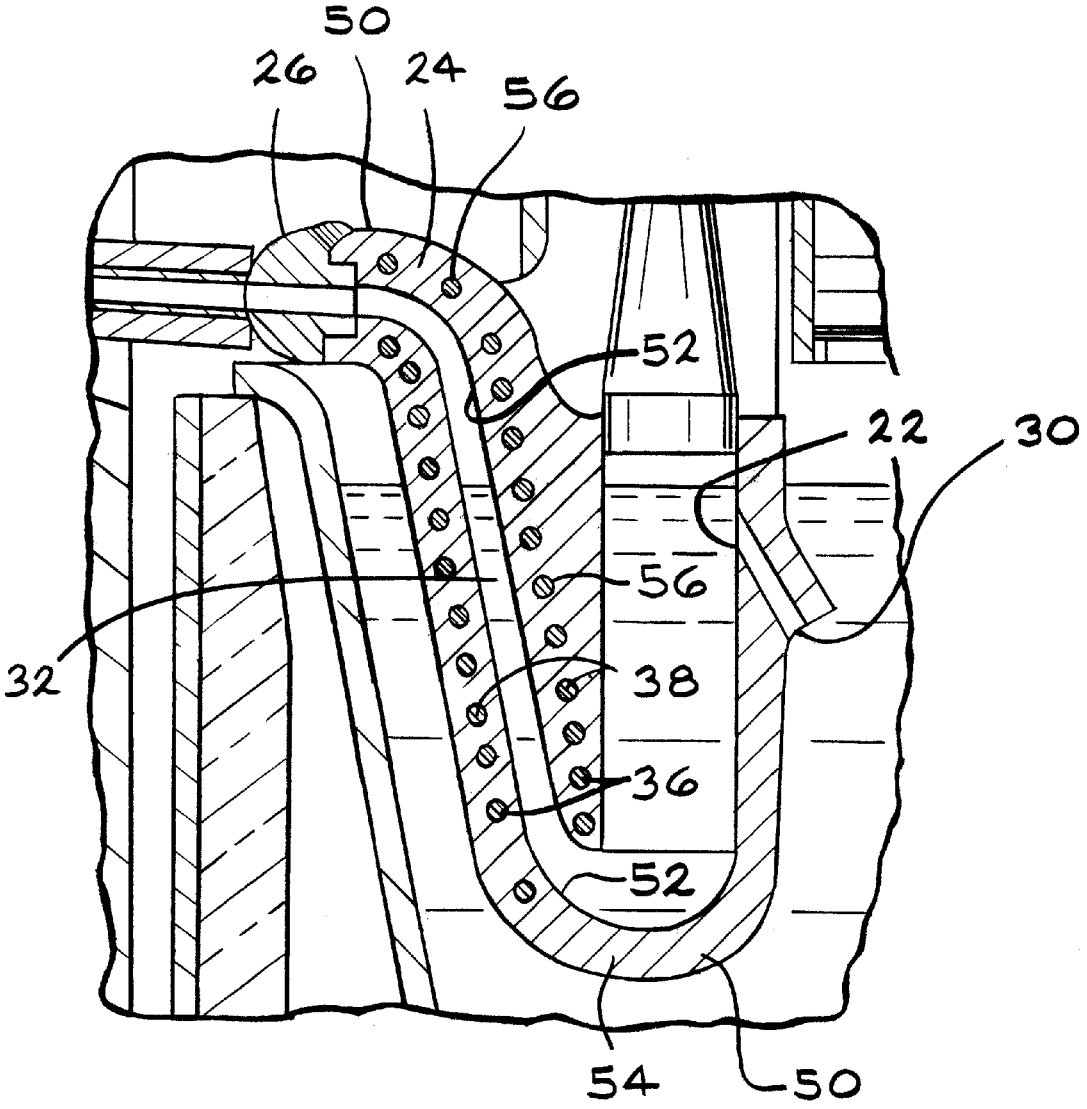
FIG. 8 is partially an exploded view of FIG. 1.

FIG. 8 is a partially exploded view of FIG. 1 showing the positioning of reinforcing members 36 and 38 in greater detail. FIG. 8 shows exterior surface 50, interior surface 52, interior 54 and fused layer 56. Interior surface 52 defines channel 32 by circumscribing or surrounding it. Exterior surface 50 and interior surface 52 incase interior 54. Interior 54 houses reinforcing members 36 and 38. Transition layer (fused layer) 56 surrounds reinforcing members 36 and 38.

Reinforcing members 36 and 38 generally have a structural configuration which can be adapted to fit interior 54. The structural configuration of reinforcing members 36 and 38 may vary widely. Generally, the structural configuration is continuous or discontinuous. Preferably, it is a wire like member readily conformable to shaping or bending. The reinforcing members may take the form of a web, mat, sheet, cylinder, spiral, cage, grid or the like. Preferably, however, the reinforcing member has a shaped, wire like structural configuration such as those shown in FIGS. 2B to 7B.

Ideally, die casting components should be made out of a metal that is smooth, wear and corrosion resistant, rigid and able to withstand the temperatures and pressures experienced in hot chamber die casting. This is especially true with the nozzle, nozzle seat and gooseneck. Applicant has found success in combining bimetallic components with the reinforcements to form a nozzle 10, wherein the nozzle 10 has an inner core or layer 11 formed of an exotic or expensive metal and an outer layer 13, grey iron, which is cast about the inner core 11. The inner core 11 forms the internal channel 32 which runs longitudinally through the nozzle 10 and carries the molten metal to the die cavity 28. The inner core must be constructed of a material that is capable of providing a smooth surface that is corrosion and wear resistant to the molten material being pumped through the bore or channel. A preferred inner core is formed of austenitic stainless steel. The outer layer 13 is preferably reinforced in the manner described above with regard to the gooseneck 24.

This type of bi-metal casting is particularly suitable for use as the nozzle 10. The reinforcing members that are utilized in the gooseneck may be incorporated within the nozzle 10, whether it be constructed of steel, bimetallic or cast. Bi-metal casting is also suitable for desired applications and for use in constructing the nozzle seat 26 and gooseneck 24.

The term "gooseneck" is not to be constructed as meaning "in the shape of a gooseneck", but merely an arrangement with a similar function and providing a duct channel or bore for the molten metal to be injected from the cylinder, upwards alongside the cylinder and laterally to a die.

The above description of the invention and the alternative embodiments is intended to be illustrative of the invention as a whole and not limiting upon the scope of the following claims. It is envisioned that the reinforcing members may be incorporated into any cast member which is exposed to internal pressures and subject to bursting and failure as a result of the pressures.

I claim:

1. An assembly for use with hot chamber die casting comprising a gooseneck assembly having a channel extending therethrough, wherein the gooseneck assembly is made from a ferrous material having reinforcing members, wherein the gooseneck assembly has an exterior surface, an interior surface and an interior located between the exterior and the interior surfaces, wherein the interior surface defines the channel extending therethrough, wherein the reinforcing members are located in the interior of the gooseneck assembly spaced away from the channel;

wherein the reinforcing members are fused to the interior; and wherein the reinforcing members have a structural configuration adapted to fit within the interior.

2. An assembly according to claim 1 wherein the reinforcing members are centrally located in the interior between the exterior and interior surfaces.

3. An assembly according to claim 1 wherein the reinforcing members are located equidistant in the interior between the exterior and interior surfaces.

4. An assembly according to claim 1 wherein the reinforcing members fused within the ferrous material provide radially oriented reinforcement within the interior of the gooseneck assembly.

5. The assembly of claim 1 wherein the ferrous material is grey iron and the reinforcing members are steel wire.

6. The assembly of claim 1 wherein the gooseneck is reinforced with reinforcing members selected from a variety of shapes, such as a U-shape with a tail, U-shape, straight rod shape, loop shape, eye loop shape or coil shape.

7. The assembly of claim 1 wherein the channel has a first end proximate a reservoir of molten metal and a second end engaged with a nozzle, the channel being cast to have a decreasing diameter when viewed from the first end to the second end and gentle curves therebetween.

8. The assembly of claim 1 wherein the interior of the gooseneck has a length and the reinforcing members are spaced along the length of the interior of the gooseneck and substantially surrounding the channel.

9. The assembly of claim 1 wherein the interior of the gooseneck has a length and the reinforcing members have a cross-sectional thickness and are evenly spaced along the length of the interior of the gooseneck and provide radial reinforcement which substantially surrounds the channel.

10. The assembly of the claim 1 wherein the reinforcing members have a cross-sectional thickness and are evenly spaced apart a distance ranging between two to three times the cross-sectional thickness of the reinforcing member.

11. The assembly of claim 1 wherein each of the reinforcing members have a cross-sectional thickness and are radially spaced from the channel a distance in the range of two to three times the cross-sectional thickness of the reinforcing member, but no greater than one-half the distance between the channel and the exterior surface of the gooseneck.

12. A hot chamber die casting machine comprising in sequence and matingly engaging: a reservoir containing non-ferrous molten metal, a pressure chamber, a gooseneck, a nozzle seat, and a nozzle; the gooseneck, nozzle seat and nozzle combining to create a channel extending therethrough and in communication with the chamber at one end and a die cavity at its opposed end, wherein at least one of the gooseneck, nozzle seat, and nozzle is made from a ferrous material having reinforcing members contained therein, wherein the gooseneck, the nozzle seat or nozzle have an exterior surface, an interior surface and an interior located between the exterior and interior surfaces, wherein the interior surface defines the channel extending therethrough, wherein the reinforcing members are located in the interior of the gooseneck nozzle seat or nozzle spaced sway from the channel;

wherein the reinforcing member are fused to the interior; and wherein the reinforcing members have a structural configuration adapted to fit within the interior.

13. The machine of claim 12 wherein the reinforcing members are fused within the ferrous material of the at least one of the gooseneck, nozzle seat, and nozzle and provide radially oriented reinforcement within the interior of the at least one of the gooseneck, nozzle seat, and nozzle.

14. The machine of claim 12 wherein the at least one of the gooseneck, nozzle seat, and nozzle is formed of bimetallic layers forming an inner layer and an outer layer, the inner layer comprising a metal highly resistant to wear and corrosion from molten die casting materials and the outer layer comprising the reinforced ferrous material.

15. The machine of claim 14 wherein the inner layer is an austenitic stainless steel and the outer layer is grey iron and the reinforcing members are steel wire.

16. The machine of claim 12 wherein the interior has a length and the reinforcing members are evenly spaced apart along the length of the interior of the at least one of the gooseneck, nozzle seat, and nozzle and provide radial reinforcement which substantially surrounds the channel.

17. The machine of claim 12 wherein at least one of the gooseneck, nozzle seat and nozzle is reinforced with reinforcing members selected from a variety of shapes, such as a U-shape with a tail, U-shape, straight rod shape, loop shape, eye loop shape or coil shape.

18. The machine of claim 17 wherein the reinforcing members have a cross-sectional thickness and are evenly spaced apart a distance ranging between two to three times the cross-sectional thickness of the reinforcing member.

19. The machine of claim 12 wherein each of the reinforcing members have a cross-sectional thickness and are spaced from the channel a distance in the range of two to three times the cross-sectional thickness of the reinforcing member, but no greater than one-half the distance between the channel and the exterior surface of the at least one of the gooseneck, nozzle seat and nozzle.

* * * * *